US005749466A

United States Patent [19]

Seki

[11] Patent Number: 5,749,466

[45] Date of Patent: May 12, 1998

[54] PACKAGING METHOD AND PACKAGING STRUCTURE FOR ARTICLES SUCH AS THOSE HAVING RECTANGULAR PARALLELEPIPED SHAPE

[75] Inventor: Seizo Seki, Miyagi, Japan

[73] Assignee: Sony Corporation, Tokyo, Japan

[21] Appl. No.: 741,292

[22] Filed: Oct. 30, 1996

Related U.S. Application Data

[63] Continuation of Ser. No. 515,599, Aug. 16, 1995, abandoned.

[30] Foreign Application Priority Data

Aug. 29, 1994 [JP] Japan ..... 6-203617
Oct. 4, 1994 [JP] Japan ..... 6-239959

[51] Int. Cl.[6] ..... B65D 85/575; B65D 65/14

[52] U.S. Cl. ..... 206/387.1; 206/497; 53/133.3; 53/416; 229/87.05

[58] Field of Search ..... 206/387.1, 459.5, 206/497; 229/87.05; 383/211; 53/461, 133.3, 416, 138.1, 376.5, 377.4

[56] References Cited

U.S. PATENT DOCUMENTS

| | | | |
|---|---|---|---|
| 2,897,087 | 7/1959 | Lawlor | 229/87.05 |
| 4,726,473 | 2/1988 | Sato et al. | 229/87.05 |
| 5,097,955 | 3/1992 | Kluter et al. | 206/387.1 |
| 5,129,518 | 7/1992 | Tanaka et al. | 229/87.05 |
| 5,423,423 | 6/1995 | Sato et al. | 206/387.1 |
| 5,505,375 | 4/1996 | Sato et al. | 206/387.1 |
| 5,510,165 | 4/1996 | Seki | 206/387.1 |

FOREIGN PATENT DOCUMENTS

| | | | |
|---|---|---|---|
| 2123376 | 2/1984 | United Kingdom | 206/387.1 |

*Primary Examiner*—Paul T. Sewell
*Assistant Examiner*—Luan K. Bui
*Attorney, Agent, or Firm*—Jay H. Maioli

[57] ABSTRACT

A packaging structure for packaging a packaged article having a rectangular parallelpiped shape, such as a tape cassette accommodating case and a disc cartridge accommodating case includes an adhesive portion and at least one non-adhesive portion formed on a portion wherein one end of a film-shaped packaging material overlaps the other end of the film-shaped packaging material when the packaged article having a rectangular parallelpiped shape is packaged by the film-shaped packaging material. The packaged article is packaged by bonding the adhesive portion and the non-adhesive portion is left as an unwrapping start portion.

16 Claims, 4 Drawing Sheets

PACKAGING METHOD AND PACKAGING STRUCTURE FOR ARTICLES SUCH AS THOSE HAVING RECTANGULAR PARALLELEPIPED SHAPE

This a continuation of application Ser. No. 08/515,599 filed Aug. 16, 1995, now abandoned.

BACKGROUND

1. Field of the Invention

The present invention relates to a packaging method and a packaging structure for packaging articles each having a rectangular parallelepiped shape. More particularly, this invention relates to a packaging method using an outer packaging film and a packaging structure for packaging articles each having a rectangular parallelepiped shape. 2. Background of the Invention It is customary that box-shaped articles such as a tape cassette and a cigarette pack are packaged by a sheet-shaped or film-shaped packaging material. A packaging paper for packaging these box-shaped articles has a cut tape or tear tape bonded thereto at substantially a predetermined position between an article and a packaging material by some suitable methods, such as bonding. The cut tape is bonded to the packaging paper so as to be nearly wound around the body of the article. One end of the cut tape is slightly extended and exposed to the side surface of the article.

After the article was packaged by the sheet-shaped or film-shaped packaging material, the packaging material is shrunk by heat shrink packaging and wholly tightened up to the article, whereafter it is tastefully tightly contacted with the article. When the user unwraps the packaging of the article, the user holds the cut tape exposed from the end portion of the packaging material placed at the side surface of the article and pulls the cut tape around the body of the article, whereby the packaging material is cut along the cut tape to unwrap the packaging of the article.

As described above, the extended portion of the cut tape is the point to start unwrapping the packaging of the article. Moreover, this unwrapping start point lies at one point on the position at which the cut tape is wound. Therefore, when the user unwraps the packaging of the article, the unwrapping start point is difficult to be visually confirmed. Furthermore, the tip end portion of the cut tape is difficult to grasp.

Even when the user tears the sheet-shaped or film-shaped packaging material by pulling the cut tape around the body of the article, the packaging material is torn along both sides of the cut tape. As a consequence, only a part of the packaging material can be removed and most of the packaging material still remains in the body of the article. For example, if the packaging material of the cigarette pack is not fully removed, then the remaining packaging material of the cigarette pack can protect the cigarette pack from damages, such as the influence of the air or moisture. On the contrary, if the packaging material of the tape cassette were not removed fully, the tape cassette accommodating case could not be undone and the tape cassette could not be taken out from the tape cassette accommodating case. For this reason, the packaging material that still remains on the tape cassette accommodating case serving as the packaging material becomes disadvantageous.

Therefore, the user has to remove the packaging material that still remains on the tape cassette accommodating case serving as the packaging material. The tape cassette accommodating case is generally made of a relatively hard material, such as plastics so that the film-shaped or sheet-shaped packaging material remaining on the article such as the tape cassette accommodating case is tensely tightly contacted with the article (tape cassette accommodating case). As a consequence, the packaging material and the tape cassette accommodating case have substantially no space formed therebetween to accept the user's finger tip. Therefore, the remaining film-shaped or sheet-shaped packaging material is difficult to be removed from the tape cassette accommodating case. Further, since the packaging material that has been removed along the cut tape is narrow in width and straight, the user cannot tear the remaining packaging material by pulling out the opening with the finger and the remaining packaging material still clings to the tape cassette accommodating case. Thus, if the tape cassette were used in order to fill sudden needs, the user could not use the tape cassette immediately.

Further, in order to easily remove the remaining packaging material from the packaging material with the cut tape, there are provided a packaging material having a slot formed on a part thereof, a packaging material having perforations or a packaging material having a plurality of cut tapes to expand the area of the packaging material to be cut.

However, the packaging material having the slots or perforations tends to be torn by heat shrinking packaging. Moreover, since the positions of the slots or perforations are not clear and the slots are difficult to be visually confirmed, the above-mentioned proposed packaging materials are rarely used in actual practice. Therefore, the remaining packaging material is still difficult to be removed and the problem of the remaining packaging material becomes serious.

A packaging material having a plurality of cut tapes has the following problems.

Such packaging material with cut tapes needs extra cut tapes and causes an automated packaging apparatus to need extra devices. Thus, the above-mentioned packaging material becomes expensive. Moreover, the packaging of the articles needs bonding processes for bonding cut tapes to the wrapping paper in the different directions. Therefore, the wrapping work cannot be carried out efficiently.

Accordingly, the packaging method using the above-mentioned packaging material and the resulting packaging structure encounters problems that should be solved, such as to improve efficiency of packaging work, to widen the unwrapping start point used when the packaged material is unwrapped, to remove a cut tape and to avoid a packaging material being left when a packaged material is unwrapped.

SUMMARY OF THE INVENTION

It is therefore an object of the present invention to provide a packaging method in which the above-mentioned problems can be solved.

It is another object of the present invention to provide a packaging structure for packaging packaged articles having rectangular parallelpiped shape in which the above-mentioned problems can be solve.

According to the present invention, there is provided a packaging method. The packaging method uses a film-shaped packaging material. The packaging method comprises the steps of forming a fixing portion and at least one non-fixing portion on a film having a first end and a second end wherein the first end of the film-shaped packaging material overlaps the second end of the film-shaped packaging material when a packaged article is packaged by the film-shaped packaging material, wrapping the packaged article with the film-shaped packaging material, packaging the packaged article by fixing the fixing portion and leaving the non-fixing portion as an unwrapping start portion.

According to the present invention, there is provided a packaging structure for packaging a packaged article having a rectangular parallelpiped shape which includes an adhesive portion and at least a non-adhesive portion. The adhesive film having a first end and a second end is formed on the portion where the first end of the film-shaped packaging material overlaps the second end of the film-shaped packaging material when the packaged article is packaged by the film-shaped packaging material. The non-adhesive portion is formed where the first end of the film-shaped packaging material overlaps the second end of the film-shaped packaging material when the packaged article is packaged by the film-shaped packaging material. The packaged material is packaged by bonding the adhesive portion to the film-shaped packaging material and the non-adhesive portion is left as an unwrapping start portion.

According to the present invention, the film-shaped packaging material can reliably be unwrapped from the unwrapping start portion without using a cut tape. Further, since the cut tape is not used, the present invention is advantageous from a money standpoint. Moreover, the packaging work can be made easy and productivity in packaging can be improved.

DESCRIPTION OF THE INVENTION

A packaging method and a packaging structure according to the present invention will hereinafter be described in detail with reference to the drawings.

A packaging method and a packaging structure according to a first embodiment of the present invention will hereinafter be described with reference to FIGS. 1 to 5.

In the first embodiment of the present invention, a box-shaped, i.e., rectangular parallelpiped packaged article, e.g., a tape cassette accommodating case is packaged by a film-shaped packaging material.

The film-shaped packaging material 1 is a transparent film made of polypropylene (PP) which demonstrates a heat-shrinking property or heat-bonding property when it is heated at 100° or higher. Design printing indicative of type of a tape cassette, a tape cassette maker and so on is made on the film-shaped packaging material 1.

Figure 1:
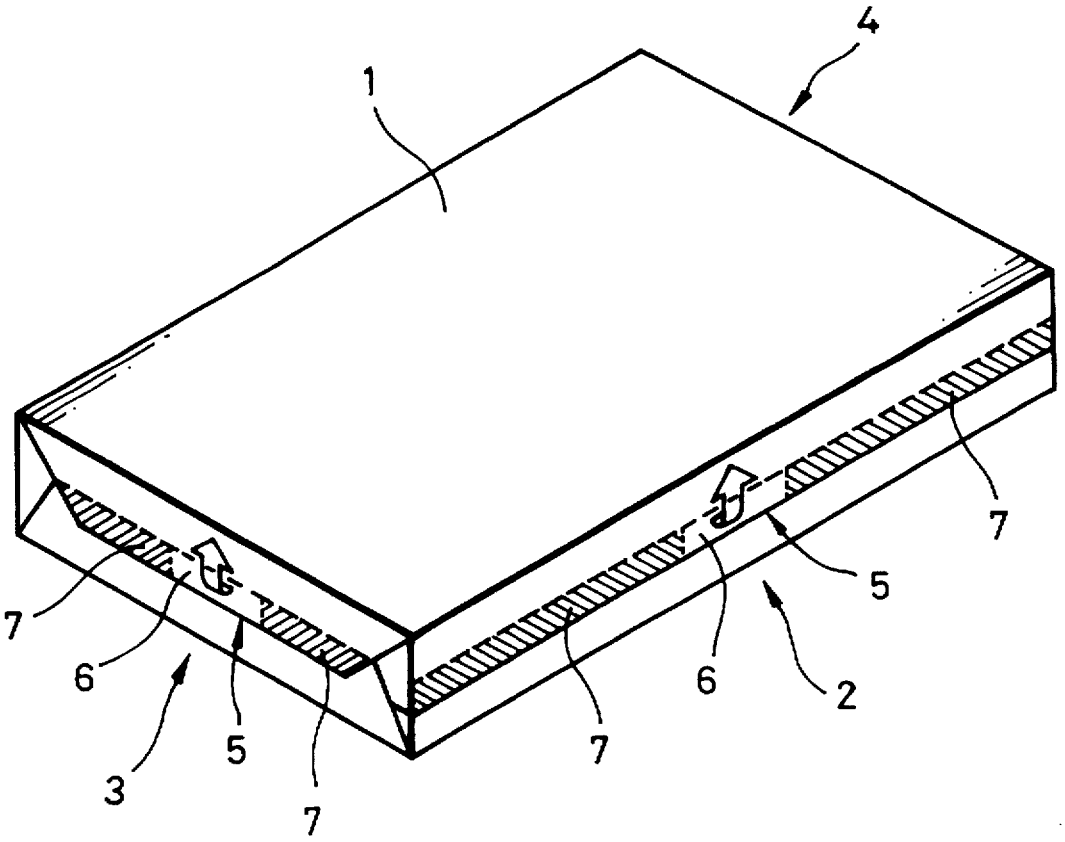
FIG. 1 is a perspective view showing a packaging structure according to a first embodiment of the present invention.
Figure 2:
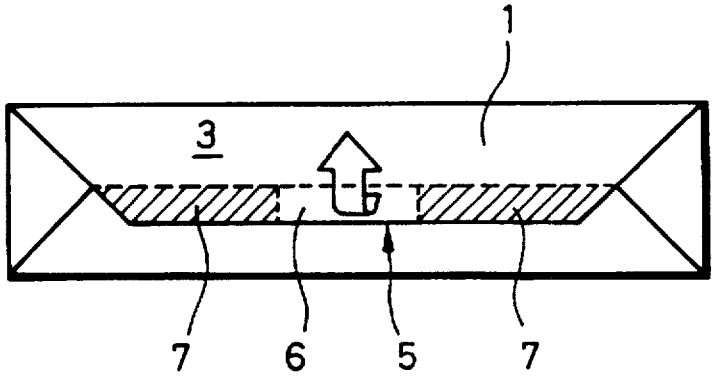
FIG. 2 is a side view showing the packaging structure shown in FIG. 1 from one side surface.
Figure 3:
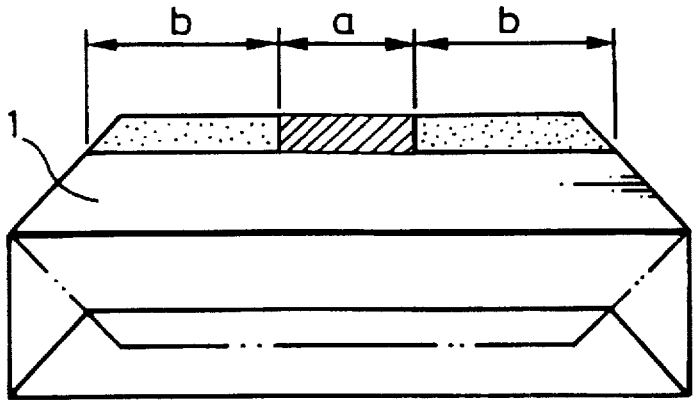
FIG. 3 is a side view showing the film-shaped packaging material having the packaging structure shown in FIG. 1 in a partly expansion plan fashion.

A tape cassette accommodating case is packaged by the film-shaped packaging material 1. Then, the thus packaged article is tightly hermetically sealed by bonding a body front surface 2 and left and right side surface 3, 4. Under the condition that the packaged article is packaged by the film-shaped packaging material 1, the film-shaped packaging material 1 is simply overlapped and the overlapping portions of the film-shaped packaging material 1 are bonded together on the body front surface 2. The body front surface 2 will hereinafter be referred to as "body seal portion 2". On the other hand, as shown in FIGS. 1, 2 and 3, the left and right side surfaces 3, 4 are folded so as to wrap the film-shaped packaging material 1. The overlapping portions of the film-shaped packaging material 1 are bonded together on the left and right side surfaces 3, 4 in a two-sided seal packaging fashion. The left and right side surfaces 3, 4 will hereinafter be referred to as "two-sided seal packaging portions 3, 4".

The film-shaped packaging material 1 is bonded to the body seal portion 2 and the two-sided seal packaging portions 3, 4 by heat sealing, for example. Specifically, when the overlapping portions of the film-shaped packaging material 1 are heated at a temperature of 100° C. or higher, the film on the heated portion is melt bonded to present a sealed state. In that case, when the film-shaped packaging material 1 is made of polypropylene having a heat shrink property, the film-shaped packaging material 1 is shrunk and tightly contacted with the packaged article.

Figure 4:
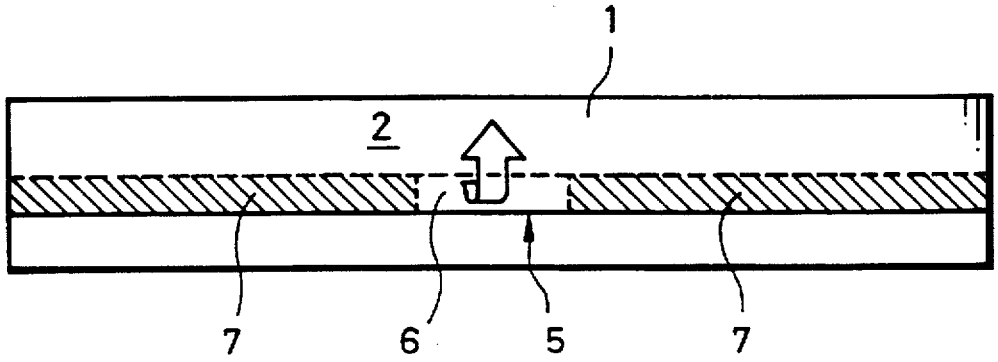
FIG. 4 is a side view showing the packaging structure shown in FIG. 1 from the other side surface and illustrating, in particular, an example of an unwrapping start portion.

In the first embodiment, as shown in FIGS. 1, 2 and 4, the body seal portion 2 and the two-sided seal package portions 3, 4 have at their central portions formed portions 5 to start unwrapping the film-shaped packaging material 1. The portion 5 will hereinafter be referred to as "unwrapping start portion 5" for simplicity.

The unwrapping start portion 5 is formed by forming a non-adhesive portion 6 having no adhesion at all on a part of the film-shaped packaging material 1 at its overlapping portions serving as the bonding portions.

The adhesion of adhesive portions 7 (shown hatched) provided at both sides of the non-adhesive portion 6 is made weaker than a normal adhesion (heat seal force inherent in polypropylene).

The non-adhesive portion 6 and the adhesive portion 7 whose adhesion is weak can be formed by printing according to the first embodiment of the present invention.

Specifically, since the film-shaped packaging material 1 is heated and melt bonded to the packaged article as described above, if the printing is made on the adhesive portion, then the adhesive portion becomes difficult to be bonded. An adhesion of the adhesive portion decreases as a printing density increases.

Therefore, according to the first embodiment, as shown in FIG. 3, on the rear surface of the overlapping portion of the film-shaped packaging material 1, there is formed a solid printing portion a by printing of dot area of 100%, i.e., solid printing as the non-adhesive portion 6. Also, on the rear surface of the overlapping portion of the film-shaped packaging material 1, there are formed printing portions b by printing of dot area of 40% with respect to the whole surface of the adhesive portion 7 or dot printing formed of a plurality of dots or halftone as the adhesive portions 7. In other words, the non-adhesive portion 6 has a printed layer formed over the whole surface of the non-adhesive layer 6. Also, the adhesive portion 7 has a plurality of dot-shaped printing portions formed thereon with a ratio of about 40% with respect to the whole surface of the adhesive portion 7.

Since the printing is made on the non-adhesive portion 6 and the adhesive portion 7 as described above, when the non-adhesive-portion 6 and the adhesive portions 7 are heated, the portion a is not bonded substantially and the portion b is bonded with an adhesion weaker than that of the normal adhesive portion (not printed).

While FIG. 3 shows only the printed pattern in the two-sided seal package portion 3 according to the first embodiment, the printed pattern in the body seal portion 2 is similar to that of the two-sided seal package portion 3.

The unwrapping start portion 5 formed when the non-adhesive portion 6 having no adhesion is formed on the adhesive surface of the film-shaped packaging material 1 has a clearance between it and the adhesive surface. Therefore, when the user unwraps the packaged article, the user inserts the fingertip or the tip end of the fingernail into the clearance formed between the unwrapping start portion and the adhesive surface to roll up the film-shaped packaging material 1 so that the adhesive portion 7 can easily be peeled from the surface of the film-shaped packaging material 1. Thus, the user can unwrap the packaged article with ease.

The unwrapping start portion 5 has a mark of an open arrow printed on its surface in order to indicate the unwrapping direction as shown in FIGS. 1, 2 and 4. The width (width a of the non-adhesive portion 6) of the unwrapping start portion 5 should preferably fall in a range from about 15 to 20 mm so that the user can easily insert the fingertip into the unwrapping start portion 5.

Further, according to the first embodiment of the present invention, since the adhesion of the adhesive portion 7 is made weaker than the normal adhesion, when the user unwraps the packaged article, the user can smoothly continuously unwrap the film-shaped packaging material 1 without strong force. Therefore, the film-shaped packaging material 1 can be prevented from being left unwrapped and the user can unwrap the packaged article rapidly reliably.

Since the unwrapping start portion 5 is composed of the non-adhesive portion 6, the unwrapping start portion 5 can be clearly distinguished from the adhesive portion 7. Therefore, those who are not accustomed to this packaging structure also can unwrap the packaged article with ease.

Since the packaging structure according to the first embodiment does not include the unwrapping cut portion unlike the prior art, this packaging structure becomes beautiful from an outer face. Also, since the packaging structure according to the first embodiment does not include the cut tape, this packaging structure becomes advantageous from a money standpoint.

Figure 5:
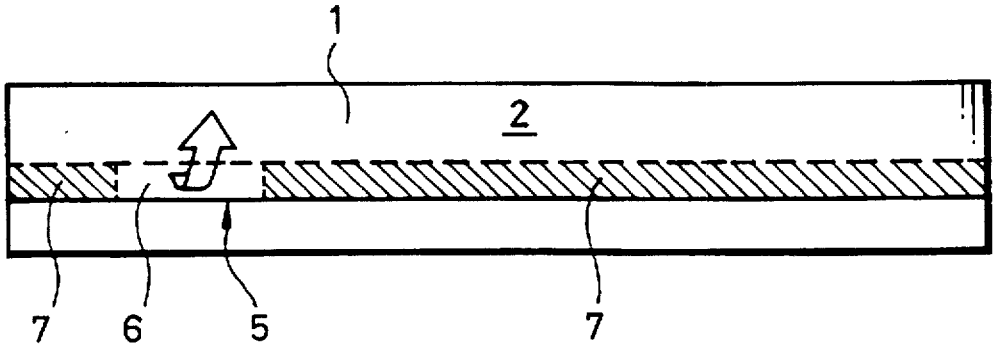
FIG. 5 is a side view showing another example of the unwrapping start portion.

Further, while the unwrapping start portion 5 is formed at the central portions of the body seal portion 2 and the two-sided seal packaging portions 3 as described above, the present invention is not limited thereto and the unwrapping start portion 5 may be formed at the position near one end of the body seal portion 2 as shown in FIG. 5.

Furthermore, while the unwrapping start portion 5 is provided at two positions, i.e., the body seal portion 2 and the two-sided seal packaging portion 3 as described above, the present invention is not limited thereto and the unwrapping start portion 5 may, of course, be formed on any one of the body seal portion 2 and the two-sided seal packaging portion 3.

A packaging method and a packaging structure according to a second embodiment of the present invention will be described below with reference to FIGS. 6 to 8.

According to the second embodiment of the present invention, a packaged article 12 having a box-shaped or rectangular parallelpiped shape is packaged by a film-shaped packaging material 11.

The box-shaped or rectangular parallelpiped packaged article 12 might be a variety of articles, i.e., a tape cassette having a recording medium such as a magnetic tape, a floppy disk, a video tape cassette, a magnetic floppy disk, a card accommodated in a case or various articles accommodated in cases. Therefore, the packaged article 12 according to this embodiment includes all articles so long as the overall arrangements of the articles are boxed-shaped or rectangular parallelpiped.

The film-shaped packaging material 1 is made of a transparent, semitransparent or opaque film material, e.g., a film having a heat-shrinking property, such as polypropylene (PP). The film-shaped packaging material 1 can seal and wrap the packaged article 12 around the body of the packaged article 12.

A seal portion used to wrap the packaged article 12 is generally referred to as a side seal. In most cases, the side seal seals the side surface of the packaged article 12 as is disclosed in the first embodiment shown in FIGS. 1, 2, 4 and 5.

Specifically, when the packaged article 12 is the tape cassette accommodating case, for example, the side surface of one long side of the rectangle and the side surfaces of two sides adjoining the long side are sealed, which is what might be called the side seal. The body seal is composed of a seal portion of a relatively wide flat surface extending across a length or width direction of the front or bottom surface side of the tape cassette accommodating case and seal portions formed on the side surfaces of the two short sides, as shown in FIG. 6.

Figure 6:
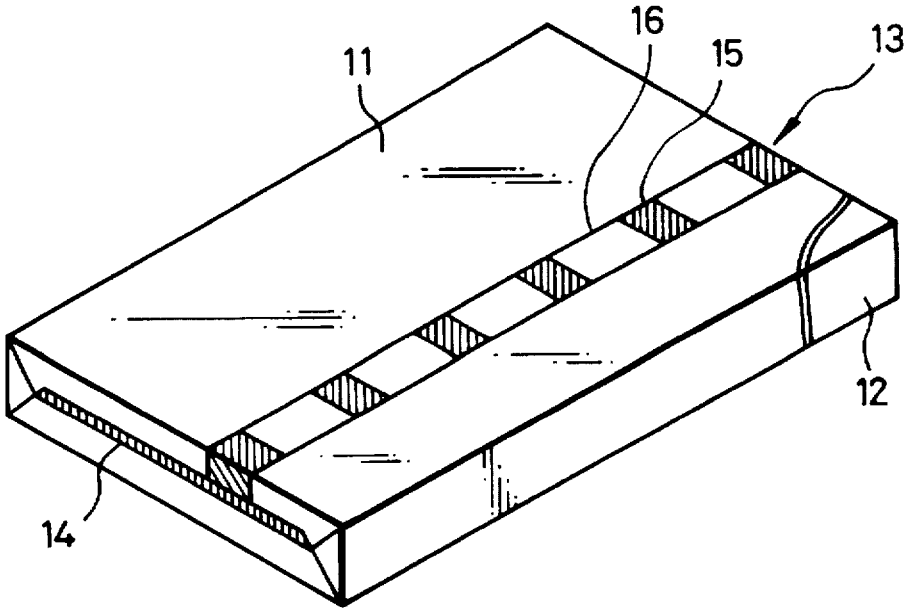
FIG. 6 is a perspective view showing a packaging structure according to a second embodiment of the present invention.

According to the second embodiment of the present invention, as shown in FIG. 6, there will be described a body seal wherein the packaged article 12 formed of the tape cassette accommodating case is sealed on its rear surface side along the length direction. A body seal portion 13 and a seal portion 14 of the side seal in the side surface of the short side are formed to package the packaged article 12.

The seal portion 13 is composed of an adhesive portion 15 and a non-adhesive portion 16. If there are alternately provided a plurality of adhesive portions 15 and non-adhesive portions 16 of predetermined lengths as shown in FIG. 6, then the non-adhesive portions 16 can be substantially formed at a part of the seal portion 13.

In this case, a width of the seal portion 13 is about 5 to 8 mm and a length of the adhesive portion 15 is approximately 7 to 15 mm. The non-adhesive portion 16 has a length long enough for the user to put his finger on, i.e., approximately 10 to 20 mm.

Figure 7:
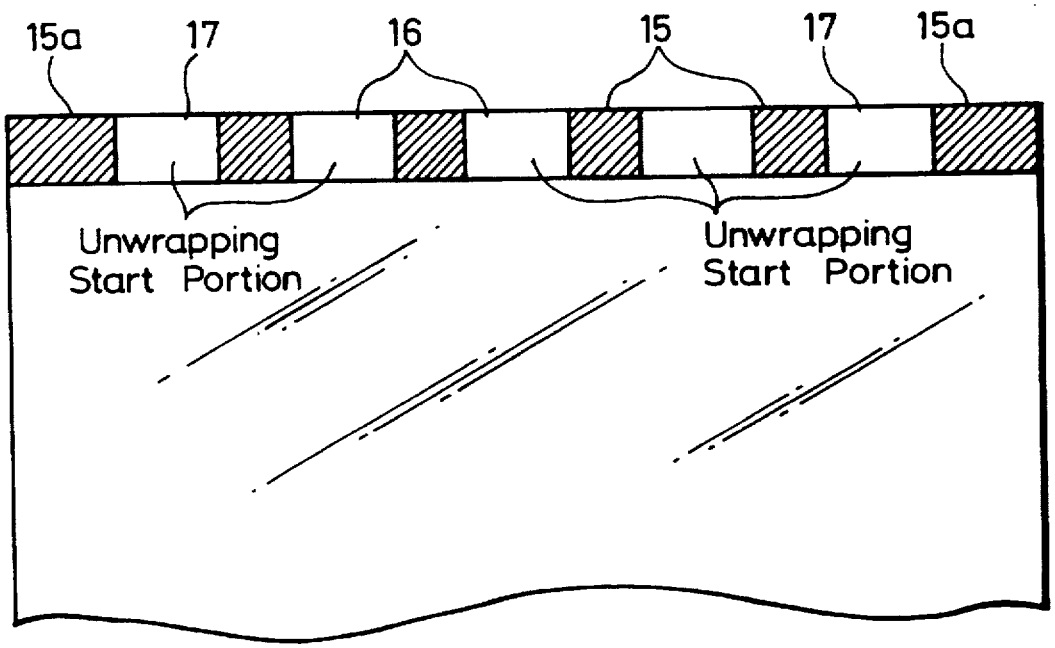
FIG. 7 is a plan view showing a part of the film-shaped packaging material according to the present invention.

As shown in FIG. 7, in the film-shaped packaging material 11, the adhesive portions 15 and the non-adhesive portions 16 are formed on one end side forming the seal portion 13. The adhesive portion 15 is formed as a weak adhesive portion having a weak adhesion. The non-adhesive portion 16 has an indication portion 17 such as "unwrapping start portion" or arrow formed thereon by some suitable means such as printing so that the user can readily visually distinguish the unwrapping start portion from other portions.

The adhesive portion 15 has an adhesion weaker than that of the seal portion 14. Specifically, the adhesive portion 15 is such one that the film-shaped packaging material 11 is partly deprived of a heat seal property, which is inherent in the film-shaped packaging material 11, by effecting some suitable process, such as varnishing or halftone printing on one end portion of the film-shaped packaging material 11 at its position opposing the adhesive portion 15.

Both end portions of the seal portion 13, i.e., adhesive portions 15*a* placed on the side surfaces of two short sides of the packaged article 12 are formed a little longer than other adhesive portions 15 such that they are placed on the corner portions ranging from the bottom surface to the side surfaces of the packaged article 12. Since the adhesive portions 15*a* are formed at the corner portions of the packaged article 12 as described above, the seal portion 13 can be prevented from being twisted after packaging. Therefore, packaged articles can be packaged stably.

The packaged article 12 is placed at the position slightly deviated from the center of the film-shaped packaging material 11. Under this condition, the seal portion 13 is heated so as to wrap the packaged article 12 by the film-shaped packaging material 11 and then the seal portion 13 is bonded to the film-shaped packaging material 11. Simultaneously, the seal portion 14 serving as the side seal is sealed to the side surface of the film-shaped packaging material 11 by a known heat-seal means. After the packaged article 12 has been packaged by the film-shaped packaging material 11, the whole package is treated by shrinking similarly to the prior art.

Since the above-mentioned packaging structure having the body seal portion 13 does not need the cut tape for unwrapping the package as described above, a packaging apparatus itself can be made inexpensive. Moreover, a packaging can be made easy and carried out efficiently.

Figure 8:
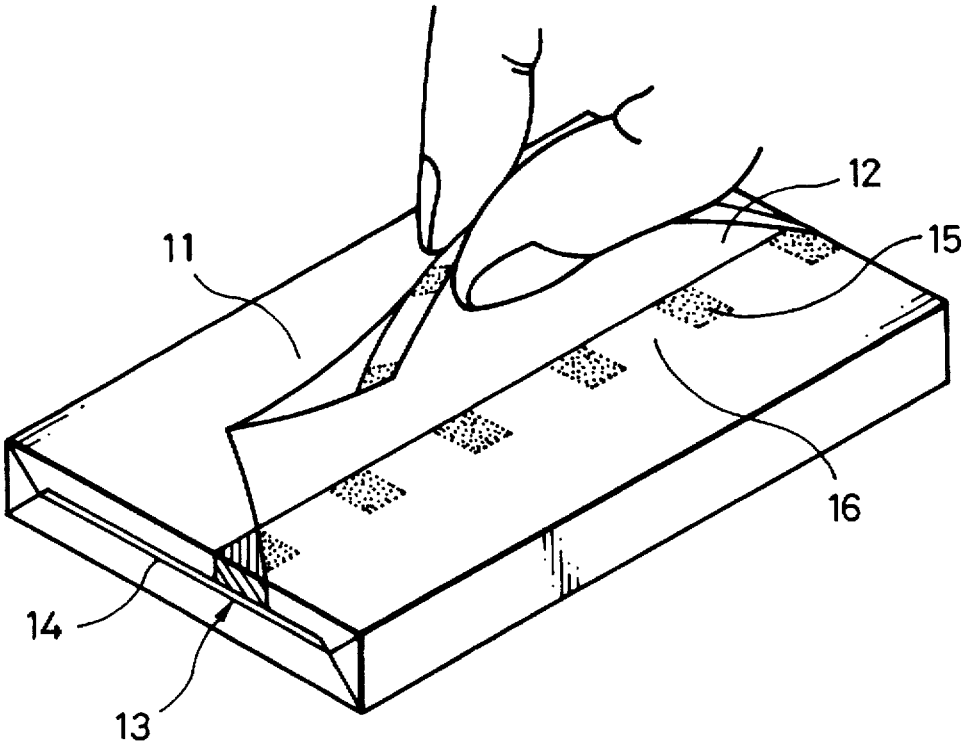
FIG. 8 is a perspective view showing the way of how to tear the seal portion of the film-shaped packaging material.

As shown in FIG. 8, when the user intends to unwrap the film-shaped packaging material 11 in order to use the packaged article 12, if the user visually confirms an indication portion 17, i.e., "unwrapping start portion" and thrusts his thumb into the unwrapping start portion, then, the non-adhesive portion 16 is opened and the nearby adhesive portions 15 also are peeled. Therefore, the user can thrust his thumb into the non-adhesive portion 16 more easily and tear the film-shaped packaging material 11 even with a very small force, whereafter the user can remove the film-shaped packaging material 11 from the torn portion thoroughly.

In this case, although the film-shaped packaging material 11 is torn at its random positions, once the film-shaped packaging material 11 is torn from somewhere, the user can tear the film-shaped packaging material 11 from the torn portion very smoothly. In addition, since the adhesion of the adhesive portion 15 in the body seal portion 13 is small, the portions of the unwrapping start portion (non-adhesive portion) 16 can be opened in a wide area and can be easily picked up by the user with the finger. Therefore, the user can smoothly undo the film-shaped packaging material 11 by holding the film-shaped packaging material of the unwrapping start portion with his finger.

The present invention is not limited to the above-mentioned embodiments and can take various modifications and variations without departing from the gist of the invention. By way of example, while the film made of polypropylene having a heat shrinking property is used as the film-shaped packaging material which can tightly package the packaged article as described above, the present invention is not limited thereto and a cellophane sheet or plastic film made of material other than the polypropylene can be used as the film-shaped packaging material.

Further, while the adhesive portion with the weak adhesion as compared with the adhesion inherent in the film-shaped packaging material is formed by effecting printing, such as halftone printing on the adhesive portion as described above, the present invention is not limited thereto and an adhesive portion of a predetermined width having a weak adhesion can be formed on at least both sides of the non-adhesive portion. In this case, the width of the adhesive portion with the weak adhesion is selected such that the user can easily satisfactorily remove the remaining packaging material with his finger put into the opening formed when the user tears the non-adhesive portion serving as the unwrapping start portion with his finger.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A packaging method using a film-shaped packaging material comprising the steps of:

forming a fixing portion, at least one printed semi-fixing portion, and at least one printed non-fixing portion on said film-shaped packaging material having a first end and a second end, wherein said semi-fixing portion is adjacent said non-fixing portion and the first end of said film-shaped packaging material and the second end of said film-shaped packaging material form an overlapped portion when a packaged article is packaged by said film-shaped packaging material, the first and second ends being unbroken in said overlapped portion;

wrapping said packaged article with said film-shaped packaging material;

packaging said packaged article by fixing said fixing portion and said semi-fixing portion; and leaving said non-fixing portion as an unwrapping start portion.

2. A packaging method according to claim 1, wherein said fixing portion and said non-fixing portion at said first end and said second end of said film-shaped packaging material have printed therebetween a weak fixing portion having a fixing force weaker than that of said fixing portion.

3. A packaging method according to claim 1, wherein said non-fixing portion has an unwrapping indication portion formed thereon.

4. A packaging method according to claim 1, wherein said semi-fixing portion and said non-fixing portion are alternately provided on said first end and said second end of said film-shaped packaging material.

5. A packaging structure for packaging a packaged article having a rectangular parallelpiped shape, comprising:

an adhesive portion formed on a film-shaped packaging material having a first end and a second end wherein the first end of said film-shaped packaging material and the second end of said film-shaped packaging material form an overlapped portion when said packaged material having said rectangular parallelpiped shape is packaged by said film-shaped packaging material, the first and second ends being unbroken in said overlapped portion;

at least one printed semi-adhesive portion formed in said overlapped portion; and at least one printed non-adhesive portion formed in said overlapped portion, whereby said packaged article is packaged by bonding said adhesive portion and said semi-adhesive portion to said film-shaped packaging material and said non-adhesive portion is left as an unwrapping start portion, wherein the bond between said semi-adhesive portion and said film-shaped packaging material is released by lifting the unwrapping start portion.

6. A packaging structure according to claim 5, wherein said adhesive portion and said non-adhesive portion at said firs end and said second end of said film-shaped packaging material have printed therebetween a weak adhesive portion having an adhesion weaker than that of said adhesive portion.

7. A packaging structure according to claim 5, wherein said non-adhesive portion has an unwrapping indication portion formed thereon.

8. A packaging structure according to claim 5, wherein said semi-adhesive portion and said non-adhesive portion are formed alternately.

9. A packaging structure according to claim 8 wherein said adhesive portions are provided so as to be placed at the corner portions of said packaged article having a rectangular parallelepiped shape.

10. A packaging method using a film-shaped packaging material comprising the steps of:

forming a fixing portion, at least one printed semi-fixing portion, and at least one printed non-fixing portion on said film-shaped packaging material having a first end wherein a first part of said first end and a second part of said first end of said film-shaped packaging material form an overlapped portion when a packaged article is packaged by said film-shaped packaging material, the first and second parts being unbroken in said overlapped portion, and wherein said semi-fixing portion is adjacent said non-fixing portion;

wrapping said packaged article with said film-shaped packaging material;

packaging said article by affixing said semi-fixing portion and said fixing portion to a respective portion of said film-shaped packaging material; and following said packaging, leaving said non-fixing portion as an unwrapping state portion.

11. A packaging method according to claim 10, wherein said fixing portion and said at least one non-fixing portion at said first end of said film-shaped packaging material have printed therebetween a fixing agent weaker than that of said fixing portion.

12. A packaging method according to claim 10, further comprising forming an unwrapping indication portion on said non-fixing portion.

13. A packaging method according to claim 10 wherein said method further comprises the steps of:

forming a sealing portion on a second end of said film-shaped packaging material; and sealing said sealing portion.

14. A packaging structure for packaging a packaged article having a rectangular parallelpiped shape, comprising:

an adhesive portion formed on a film-shaped packaging material having a first end wherein a first part of said first end and a second part of said first end of said film-shaped packaging material form an overlapped portion when said packaged material having said rectangular parallelpiped shape is packaged by said film-shaped packaging material, the first and second parts being unbroken in said overlapped portion;

at least one printed semi-adhesive portion formed in said overlapped portion; and at least one printed non-adhesive portion in said overlapped portion, whereby said packaged article is packaged by bonding said adhesive portion and said semi-adhesive portion to said film-shaped packaging material; and whereby said non-adhesive portion forms an unwrapping start portion, wherein the bond between said semi-adhesive portion and said film-shaped packaging material is released by lifting the unwrapping start portion.

15. A packaging structure according to claim 14, wherein said non-adhesive portion has an unwrapping indication portion formed thereon.

16. A packaging structure according to claim 14, wherein said structure further comprises a sealing portion on a second end of said film-shaped packaging material.

* * * * *